United States Patent [19]

Colleran et al.

[11] Patent Number: 4,813,885

[45] Date of Patent: Mar. 21, 1989

[54] WIRING HARNESS CONNECTOR RETAINER

[75] Inventors: Stephen A. Colleran, Lisle; Lawrence E. Geib, Carol Stream, both of Ill.

[73] Assignee: Molex Incorporated, Lisle, Ill.

[21] Appl. No.: 213,207

[22] Filed: Jun. 29, 1988

[51] Int. Cl.[4] ..... H01R 13/60

[52] U.S. Cl. ..... 439/565; 439/552; 248/27.3

[58] Field of Search ..... 439/527, 544, 545, 552–554, 439/562, 565; 248/27.1, 27.3

[56] References Cited

U.S. PATENT DOCUMENTS 3,643,132 2/1972 Odmark ..... 439/552

4,434,339 2/1984 Ohashi ..... 248/27.3

OTHER PUBLICATIONS

Molex Full Line Catalog No. 870, pp. 66A–70A, 1988.

*Primary Examiner*—Gary F. Paumen

*Attorney, Agent, or Firm*—John W. Cornell; Louis A. Hecht

[57] ABSTRACT

A wiring harness assembly includes an electrical connector terminated to a cable including several electrical conductors. The connector is mounted in a cavity defined between front, rear and side walls of a retainer including snap mounting structure for securing the retainer in a panel opening. A connector doorway in a retainer side wall permits the connector to be loaded into the side wall in a direction transverse to the connector mating direction, and the rear wall prevents contact mating forces from pushing the connector from the retainer. The connector is releasably retained in the cavity, and can be removed in the transverse direction for repair or replacement. The connector has freedom of movement within the retainer to facilitate automated assembly.

16 Claims, 3 Drawing Sheets

WIRING HARNESS CONNECTOR RETAINER

FIELD OF THE INVENTION

The present invention relates to wiring harnesses including electrical conductors and electrical connectors, and more particularly to improvements in connector retainers for wiring harness assemblies.

DESCRIPTION OF THE PRIOR ART

A wiring harness is an assembly of one or more electrical cables including multiple electrical conductors connected to one or more electrical connectors. Such harnesses are used in a wide variety of manufactured products for making electrical connections between various electrical circuit devices including many types of wiring boards, connectors, components and the like.

In some types of electrical and electronic equipment, it is desirable to connect a wiring harness to another electrical device at a panel such as a housing or chassis. In the past, this has often been done by attaching an electrical connector of the wiring harness, or an electrical connector to be mated with the wiring harness, directly to the panel. However, this approach suffers from disadvantages. One is that attachment of a connector directly to the panel can require complex and expensive assembly operations that are difficult to automate. Another disadvantage is that it may be difficult to disassemble the connector from the panel for repair or replacement.

In order to avoid the necessity for direct attachment of an electrical connector to a panel, devices known as clips or retainers have been used. Such a device typically is a housing that can be attached to a panel, for example by snapping into a locked position in a preformed panel opening. The housing then receives an electrical connector, such as a connector at an end of a wiring harness. An example of a known retainer is a single row panel mount connector assembly, part No. 70018, sold by Molex Incorporated, Lisle, Ill. This device is a molded plastic housing mounted in a preformed panel opening by a snap arm panel mount system. Electrical connectors are loaded into the housing and snap in place in the housing where they are held in position.

Known retainers or clips are not well suited for wiring harness installations where repair or replacement may be required in close quarters. One reason for this is that the connector moves relative to the retainer in the direction of contact mating. Another difficulty is a tendency for the electrical connector to be pushed out of the retainer when a second connector or other device is mated to the connector. In addition, the fact that the connector is held in a fixed position within the retainer increases the difficulty of using automated equipment, such as robotic equipment, for applying test contacts to the retained connector or for mating a second connector or other device.

SUMMARY OF THE INVENTION

Among the important objects of the present invention are to provide an improved panel mount retainer for an electrical connector that facilitates assembly as well as repair and replacement; to provide a retainer avoiding any tendency of an electrical connector to be pushed out of the retainer during mating with the connector; to provide a retainer that is well suited for automated testing and assembly; to provide a wiring harness assembly including a retainer in which an electrical connector of a wiring harness may be preassembled for later mounting of the retainer to a panel; and to provide improvements in retainers and wiring harnesses in order to overcome difficulties experienced with those used in the past.

In brief, in accordance with the above and other objects of the present invention, there is provided a panel mount retainer for a wiring harness interconnect system of the type including a multiple circuit electrical connector having a connector housing, a plurality of electrical terminals in the housing and a plurality of conductors connected to the terminals. The retainer is used with a panel having an opening and with a plurality of mating contacts movable in a mating direction relative to the connector for engagement with the terminals of the connector. The retainer includes a retainer housing having a forward end, a read end, and side walls extending between the forward and rear ends in a direction generally parallel to the mating direction. The side walls define a cavity within the retainer housing for receiving the connector housing. The retainer housing is receivable in the opening in the mounting panel, and includes panel mounting means engageable with the panel for securing the retainer onto the panel with its forward end accessible at one side of the panel and with its rear end extending from the opposite side of the panel. The forward end of the retainer housing includes a contact receiving opening for permitting the contacts to engage the terminals of the connector upon movement of the contacts in the mating direction relative to the panel.

In accordance with a feature of the present invention, the retainer includes a connector doorway defined in the side walls for permitting the connector to move into and out of the cavity in a direction generally transverse to the mating direction. In addition, the retainer housing defines a rear stop adjacent the rear end of the retainer housing for limiting rearward movement of the connector in the cavity in the mating direction when the contacts are engaged with the terminals.

In accordance with another aspect of the present invention, there is provided a wiring harness assembly including an electrical connector with a connector housing, a plurality of electrical terminals in the housing and a mating recess in a first end of the connector housing communicating with the electrical terminals. A cable includes a plurality of conductors terminated to the electrical terminals and extending away from a second end of the connector housing. A retainer includes a retainer housing having forward and rear ends and defining a cavity. The connector is disposed within the cavity, and the retainer housing includes mounting means for mounting the retainer in a predetermined location. The forward end of the retainer housing has a contact receiving opening adjacent the mating recess in the connector housing. The retainer defines a rear stop engageable with the connector housing for limiting movement of the connector housing toward the rear end of the retainer housing. The retainer housing includes a wall extending between the forward and rear ends, and a connector doorway is formed in the retainer housing wall.

BRIEF DESCRIPTION OF THE DRAWINGS

The present invention together with the above and other objects and advantages may best be understood from the following detailed description of the embodiment of the invention illustrated in the drawings, wherein.

DETAILED DESCRIPTION OF THE PREFERRED EMBODIMENT

Figure 1:
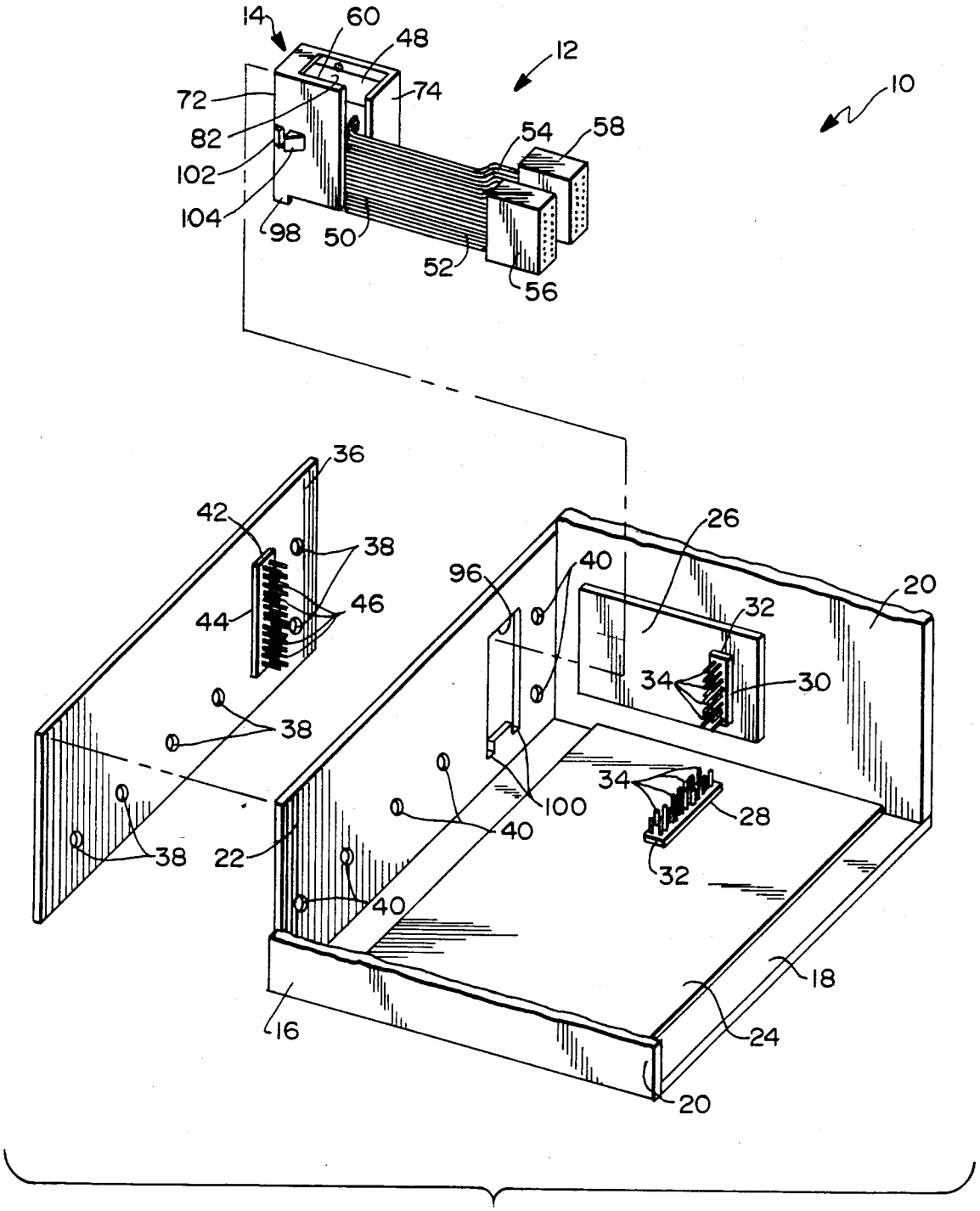
FIG. 1 is an exploded perspective view of selected components of an electrical device including a wiring harness assembly embodying the present invention, the wiring harness assembly including a retainer also embodying the present invention.
Figure 2:
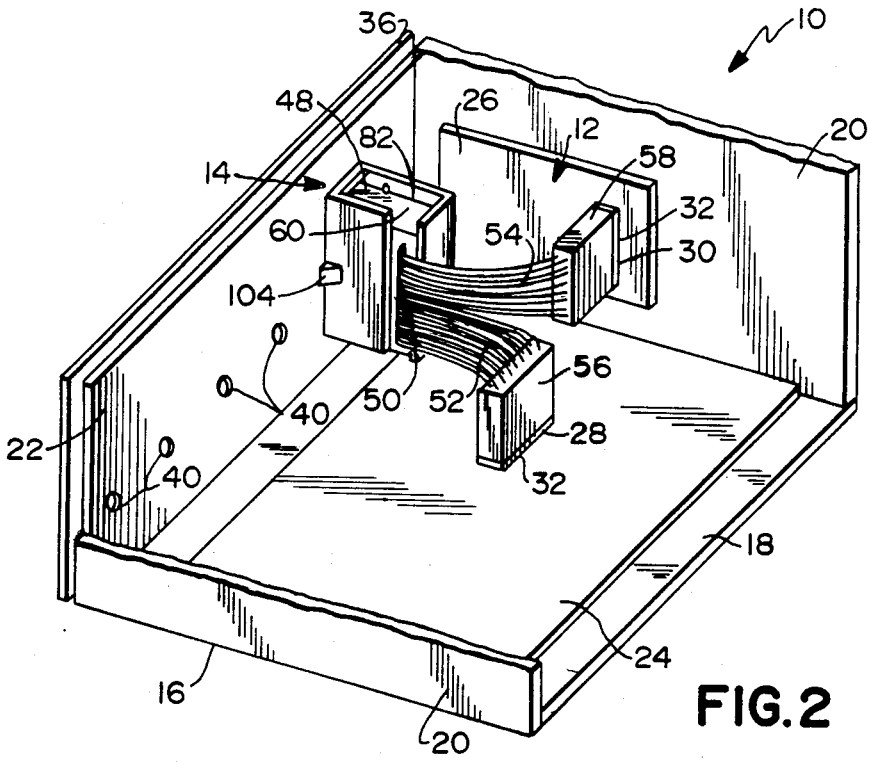
FIG. 2 is a perspective view of the structure shown in FIG. 1 after assembly of the selected components.
Figure 3:
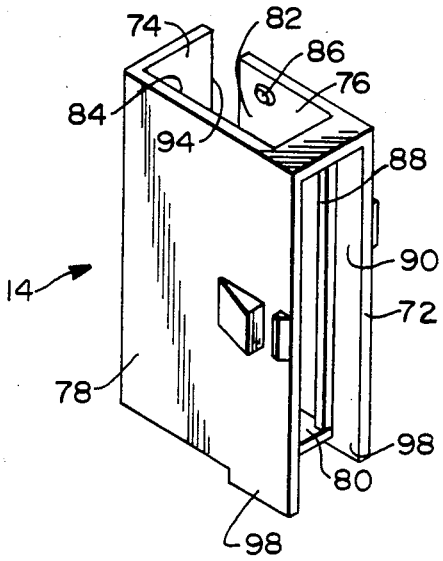
FIG. 3 is a perspective view of the retainer of FIGS. 1 and 2.

Having reference now to the drawings, and initially to FIGS. 1 and 2, there are illustrated selected components of an electrical device generally designated as 10. Among the components of the device 10 is a wiring harness assembly generally designated as 12 and constructed in accordance with the principles of the present invention. The wiring harness assembly 12 includes a retainer generally designated as 14 also constructed in accordance with the principles of the present invention. Use of the wiring harness assembly 12 and retainer 14 in the electrical device 10 facilitates assembly, testing, repair and replacement of various components of the assembly.

Device 10 includes a housing or chassis 16 shown in fragmentary form and incorporating a bottom wall 18 and side walls 20. A front panel 22 is also provided. Panel 22 may be an integral part of chassis 16 or may be a separate component. In the illustrated embodiment of the invention, device 10 is an automotive audio unit such as a compact disc player. However, the present invention is applicable to a wide variety of other electrical and electronic devices. Only those components of the device 10 helpful to an understanding of the present invention are illustrated, other components being eliminated for clarity.

Many of the components of the device 10 are mounted within the chassis 16. These include a main printed circuit wiring board 24 supported above the bottom wall 18 and an auxiliary printed circuit wiring board 26 mounted within one of the side walls 20. Printed circuit boards 24 and 26 respectively are provided with electrical connectors 28 and 30 each including a body 32 formed of an insulating plastic material and secured to the respective circuit board 24 or 26. Each body 32 supports an array of male contact pins or posts 34 connected in conventional manner to circuit paths on the printed circuit boards 24 and 26.

A front board 36 is adapted to be supported in front of the front panel 22. Board 36 and panel 22 include a matching array of aligned openings 38 and 40. In the illustrated embodiment, the openings 38 and 40 accommodate shafts of control knobs used to operate the device 10. Front board 36 also includes a connector 42 having an insulating plastic body 44 mounted to the board 36 and supporting an array of male contact pins or posts 46 connected to conductive paths on the front board 36. The connectors 28, 30 and 42 are generally of the type known as headers with the pins or posts 34 and 46 serving as male contacts for mating with female contacts in electrical connectors. However, other types of connectors and mating systems may be employed with the present invention.

When the components of the device 10 are assembled as illustrated in FIG. 2, the wiring harness assembly 12 of the present invention makes electrical connections between the connector 42 and the connectors 28 and 30. The wiring harness assembly 12 includes an electrical connector 48 terminated to the electrical conductors of a wiring cable 50. Cable 50 forks along its length into a pair of smaller cables 52 and 54. Cables 52 and 54 are respectively terminated to electrical connectors 56 and 58. In the assembled condition, connector 48 mates with connector 42 while connectors 56 and 58 mate respectively with connectors 28 and 30. Thus the wiring harness assembly 12 makes electrical connections between selected conductive paths on the printed circuit boards 24 and 26 and on the front board 36.

Figure 4:
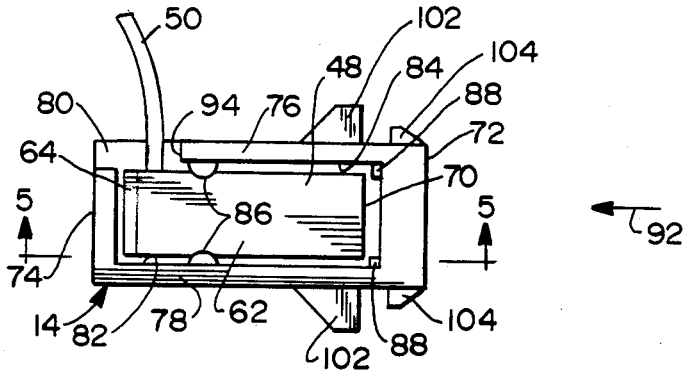
FIG. 4 is a top view of part of the wiring harness assembly of FIGS. 1 and 2 illustrating the retainer and an electrical connector mounted within the retainer.
Figure 5:
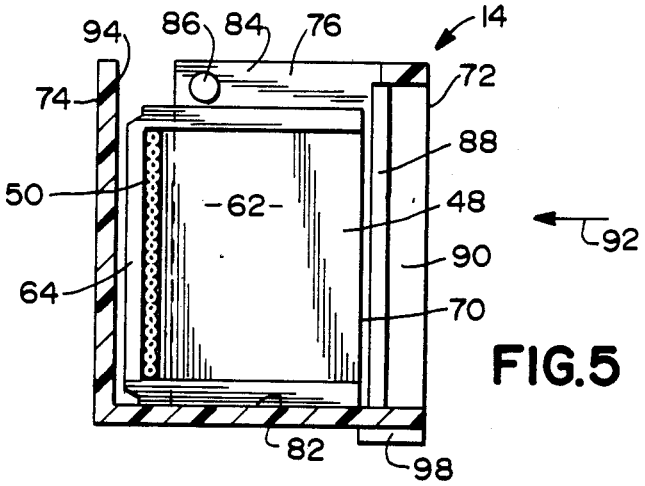
FIG. 5 is a sectional view taken along the line 5—5 of FIG. 4.
Figure 6:
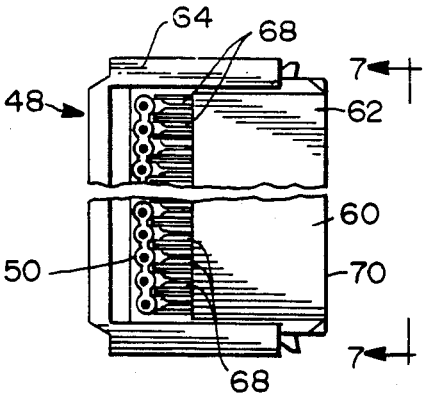
FIG. 6 is a fragmentary side view of the electrical connector seen in FIGS. 4 and 5 prior to termination of the connector to a cable.
Figure 7:
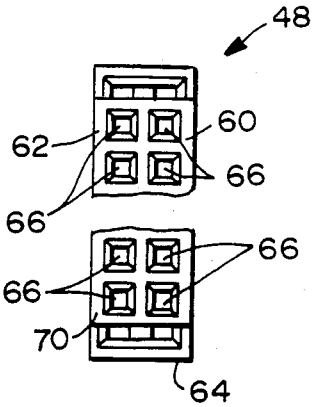
FIG. 7 is a front view of the connector of FIG. 6 taken from the line 7—7 of FIG. 6.

Electrical connector 48 is seen in more detail in FIGS. 4–6. While the present invention is applicable to wiring harnesses with connectors of many different types, in the illustrated arrangement connector 48 includes a housing 60 formed of an electrically insulating material such as molded plastic including a body portion 62 and a relatively movable cap 64. A number of recesses 66 formed in body 62 enclose a plurality of electrical terminals 68. When cable 50 is inserted between the body 62 and cap 64 as shown in FIG. 6, the cap 62 can be closed by moving it toward the body 62 and insulation displacement contact portions of the terminals 68 make electrical connections with each of the electrical conductors of the cable 50. Recesses 66 extend to a front wall 70 of the connector 48. When the connectors 48 and 42 are moved relative to one another in the mating direction, the male contacts 46 are received within recesses 66 to make electrical connections with contact portions of the terminals 68 within the connector body 62.

Connectors 56 and 58 of the wiring harness assembly 12 may be of any desired type. In the illustrated arrangement, these connectors are of the in-line cable entry type in which electrical terminals (not shown) enclosed within the connectors make electrical contact with wires of the cables 52 and 54, either with crimp or insulation displacement contact portions. Alternatively, if desired, the connectors 56 and 58 may be similar in structure and operation to the connector 48. In addition, the principles of the invention may be applied to a wiring harness with unterminated conductors in place of one or both connectors 56 and 58, with a single connector instead of connectors 56 and 58, or having other configurations.

The retainer 14 of the present invention is a one-piece, integral molded plastic body or housing including a forward end 72 and a rear end wall 74. Side walls 76, 78 and 80 extend between the forward and rear ends of the retainer. A cavity 82 is defined within the walls of the retainer 14 for receiving the electrical connector 48.

A connector doorway 84 is defined at one side of the retainer 14 between the forward end 72 and rear wall 74 and between the side walls 76 and 78. Doorway 84 permits the electrical connector 48 to be loaded into and removed from the cavity 82 of the retainer 14. The electrical connector 48 is frictionally and removably held in place within cavity 82 by a pair of retaining projections or detents 86 extending inwardly from side walls 76 and 78.

After the connector 48 has been loaded into cavity 82 of the retainer 14, it is securely but loosely held in place with a predetermined amount of "play" or freedom of movement. Forward end 72 includes a pair of stop portions 88 flanking an opening 90. Opening 90 permits connector 48 to mate with connector 42, while the stop portions 88 limit movement of the connector 48 in the forward direction. The connector mating direction is indicated by arrow 92 in FIGS. 4 and 5. When connector 48 is mated with contacts, such as those of another connector, the rear end wall 74 limits movement of the connector 48 in the rearward, contact mating direction. As seen in FIGS. 4 and 5, clearance is provided between the connector 48 and stop portions 88 and between connector 48 and rear wall 74 for a predetermined degree of looseness. Side walls 76 and 78 are also spaced apart somewhat more than the corresponding dimension of connector 48 as seen in FIG. 4. Similarly, clearance is provided between the retaining projections 86, the side wall 80 and the housing of connector 48. Thus a limited degree of freedom of looseness or play is provided in all axes of movement.

A slot 94 is provided in the side of retainer 14 between side walls 80 and 76. As the connector 48 is loaded through the doorway 84, the cable 50 is received in the slot 94. Slot 94 not only provides clearance for the cable 50, but also serves as a polarization structure because the connecter 48 with cable 50 attached can only enter the doorway 84 into the cavity 82 in a single, predetermined orientation.

In order to permit mounting of retainer 14 on the front panel 22, the panel 22 is provided with a preformed opening 96 similar in shape to the shape of the front of the retainer 14. A pair of polarizing projections 98 are formed at the base of the front end 72 of the retainer 14, and a pair of matching polarizing notches 100 are provided at the bottom of the opening 96. Retainer 14 can be received into opening 96 in only a single predetermined orientation. Retainer 14 is snapped into place for mounting on panel 22 and is retained by stop projections 102 and snap latch projections 104 provided on opposed side walls 76 and 78 of the retainer.

One advantage of the present invention is that the wiring harness assembly 12 including the retainer 14 can be preassembled as a single subassembly capable of being handled and incorporated into the electrical device 10 as a single unit. In order to manufacture this subassembly, the cable 50 is prepared and its electrical conductors are terminated to the electrical connectors 48, 56 and 58. The connector 48 with attached cable 50 is then loaded through doorway 84 into the cavity 82 of retainer 14 where it is held in place by retaining projections 86. This completed subassembly can then be shipped and/or held in inventory until needed for the electrical device 10.

In assembling the components of electrical device 10, the retainer 14 is mounted into the opening 96 in front panel 22. The connectors 56 and 58 are mated with the connectors 28 and 30 on the printed circuit boards 24 and 26. At this point in the assembly process, the front board 36 can be moved into position. During this movement, the male contacts of the connector 42 mate with the terminals 68 of the connector 48.

More specifically, as the front board 36 moves in the mating direction 92, the pins or posts 46 move through the opening 96 in the front panel 22 and through the opening 90 in the retainer 14. The body 44 of the connector 42 may also move through these openings. As movement in the mating direction continues, the pins or posts 46 enter the recesses 66 in the housing 60 of connector 48 to a seated or home position in which contact is made between the pins or posts 46 and the terminals 68.

Automated equipment, such as robotic equipment, may be used for this assembly operation. Due to the fact that the connector 48 is held loosely within the retainer 14, the connector 48 can move to adjust to comply with the pins or posts 46, and it is not necessary that the connector 42 mounted upon the front board 36 be installed manually or be installed in a precisely accurate position and orientation.

The looseness with which connector 48 is retained also facilitates testing with automated equipment. For example, a test connector or contact probe array like the connector 42 may be automatically mated with connector 48 for test purposes. The looseness of connector 48 in retainer 14 makes it possible to use automatic equipment rather than manual mating of a test connector.

Another feature of the invention that facilitates automatic assembly arises from the fact that the connector doorway 84 is in a side wall of the retainer, permitting the rear wall 74 to limit movement of the connector in the rearward direction. Substantial contact forces may be encountered as the connector 42 is moved in the mating direction into engagement with the connector 48. Such forces may tend to push the connector 48 in the rearward direction. Since the connector 48 is loaded from the side rather than from the rear of the retainer, the rear wall 74 is capable of absorbing these mating forces and transferring them to the front panel 22.

A further advantage of the retainer 14 comes into play should repair or replacement be required after assembly of the electrical device 10. The device 10 may include numerous components in addition to those illustrated, and for compactness it is desired that these components be located close together. Thus, it may be undesirable to provide the clearance at the rear of retainer 14 such as is necessary in known retainers for removing a connector rearwardly, in the contact mating direction from the retainer. With the present invention, the connector 48 can be removed through doorway 84 in a side wall of the retainer, rather than to the rear.

While the invention has been described with reference to details of the illustrated embodiment, these details are not intended to limit the scope of the invention as defined in the appended claims.

We claim:

1. A panel mount retainer for a wiring harness interconnect system of the type including a multiple circuit electrical connector having a connector housing, a plurality of electrical terminals in the connector housing, a plurality of conductors connected to the terminals and extending from the connector housing, a mounting panel, an opening in the panel and a plurality of mating contacts movable in a mating direction relative to the connector for engagement with the terminals, said retainer comprising:

a retainer housing having a forward end, a rear end and side walls extending between said ends in a direction generally parallel to said mating direction;

said side walls defining a cavity within said retainer housing for receiving the connector housing;

said retainer housing having a shape receivable in the opening in the mounting panel;

panel mounting means on the exterior of said retainer housing engagable with the panel for securing the retainer upon said panel with the forward end of the retainer housing accessible at one side of the panel and the rear end of the retainer housing extending from the opposite side of the panel;

a contact receiving opening defined in said forward end of said retainer housing for permitting the contacts to engage the terminals of the connector upon movement of the contacts in the mating direction relative to the panel;

said retainer further being characterized by:

a connector doorway defined by said side walls for permitting the connector to move into and out of said cavity in a direction generally transverse to the mating direction; and a rear stop defined by the retainer housing adjacent said rear end of said retainer housing for limiting rearward movement of the connector in said cavity in the mating direction when the contacts are engaged with the terminals.

2. A panel mount retainer as claimed in claim 1, further comprising latch means on said retainer housing adjacent said doorway for releasably retaining the connector in said cavity.

3. A panel mount retainer as claimed in claim 2, said latch means comprising at least one projection frictionally interfering with the connector in said doorway.

4. A panel mount retainer as claimed in claim 1, further comprising connector polarizing means for permitting the connector to enter said doorway in only a single predetermined orientation.

5. A panel mount retainer as claimed in claim 4, said connector polarizing means including a slot in said retainer housing for receiving the plurality of conductors as the connector enters said doorway.

6. A panel mount retainer as claimed in claim 4, further comprising retainer polarizing means on said retainer housing for permitting said retainer housing to be secured to the panel in only a single orientation of said retainer housing.

7. A panel mount retainer as claimed in claim 1, said cavity being oversize relative to the connector housing for holding the connector housing loosely in said cavity to provide limited freedom of movement during engagement of the contacts with the terminals of the connector.

8. A panel mount retainer as claimed in claim 7, said panel mounting means including lock means engagable with both sides of the panel for securing the retainer in a fixed position upon the panel.

9. A panel mount retainer as claimed in claim 1, said rear stop comprising a rear wall located at said rear end of said retainer housing.

10. A wiring harness assembly comprising:

an electrical connector including a connector housing, a plurality of electrical terminals in said housing and mating recess means in a first end of said connector housing communicating with said electrical terminals;

a cable including a plurality of conductors terminated to said electrical terminals and extending away from a second end of said connector housing;

a retainer including a retainer housing having forward and rear ends and defining a cavity;

said connector being disposed within said cavity;

said retainer housing including mounting means for mounting said retainer in a predetermined location on and normal to a flat panel;

a contact receiving opening in said forward end of said retainer housing adjacent said mating recess means;

a rear stop defined by said retainer housing and engagable with said connector housing for limiting movement of said connector in said cavity toward said rear end of said retainer housing;

a retainer housing wall extending between said forward and rear ends of said retainer housing; and a connector doorway in said retainer housing wall for permitting the connector to move into and out of said cavity in a direction generally parallel to said flat panel.

11. The wiring harness assembly defined in claim 10 further comprising cable receiving slot means in said retainer housing intersecting said connector doorway.

12. The wiring harness assembly defined in claim 10 further comprising friction interference detent means adjacent said doorway engagable with said connector housing.

13. The wiring harness assembly defined in claim 10 further comprising interior wall surfaces of said retainer housing defining said cavity and spaced from said connector housing for providing freedom of movement of said connector housing in said cavity.

14. The wiring harness assembly defined in claim 10, further comprising a second electrical connector attached to at least some of said conductors of said cable at a region spaced from said retainer.

15. The wiring harness assembly defined in claim 14, further comprising a third electrical connector attached to at least some of said conductors of said cable at a region spaced from said retainer.

16. The wiring harness assembly defined in claim 15, said second and third electrical connectors being attached to different ones of said conductors.

* * * * *